US006668136B2

(12) United States Patent
Henry et al.

(10) Patent No.: US 6,668,136 B2
(45) Date of Patent: Dec. 23, 2003

(54) INTEGRAL HEATING AND COOLING UNIT

(75) Inventors: Sam W. Henry, Ogden, UT (US); Paul Neilson, Pleasant View, UT (US); Randy C. Jarrett, Mantua, UT (US); Steven U. Nestel, Ogden, UT (US); Donald M. Cunningham, Pittsburgh, PA (US)

(73) Assignee: Chromalox, Inc., Pittsburgh, PA (US)

( * ) Notice: Subject to any disclaimer, the term of this patent is extended or adjusted under 35 U.S.C. 154(b) by 295 days.

(21) Appl. No.: 09/879,650

(22) Filed: Jun. 12, 2001

(65) Prior Publication Data

US 2002/0186969 A1 Dec. 12, 2002

(51) Int. Cl.[7] ..... F24H 1/00
(52) U.S. Cl. ..... 392/496; 165/154
(58) Field of Search ..... 392/496, 495; 165/154, 201

(56) References Cited

U.S. PATENT DOCUMENTS 2,852,232 A * 9/1958 Marwell ..... 165/263
2,976,392 A * 3/1961 Wabnitz ..... 392/495
4,375,027 A * 2/1983 Zeto et al. ..... 219/390
4,855,569 A 8/1989 Wiedemann ..... 219/306
5,265,318 A 11/1993 Shero ..... 29/447
6,076,357 A 6/2000 Holdren et al. ..... 62/3.2
6,157,778 A * 12/2000 Kadotani ..... 392/483

* cited by examiner

*Primary Examiner*—Sang V. Paik
*Assistant Examiner*—Thor Campbell
(74) *Attorney, Agent, or Firm*—Kirkpatrick & Lockhart LLP

(57) ABSTRACT

An integral heating and cooling unit is disclosed. The integral heating and cooling unit controls the temperature of a working fluid by heating or cooling the fluid either independently or in tandem. The integral heating and cooling unit includes a casing or outer housing, which defines a plenum. A heat exchanger pipe is attached to the outer housing and passes through the plenum. A plurality of heating elements connects to the outer housing and extends into the plenum. The heating elements heat the working fluid when they are powered and the working fluid passes through the plenum. The heat exchanger pipe extracts heat from the working fluid when a cooling fluid passes through the pipe and in heat transfer relation with the working fluid.

28 Claims, 11 Drawing Sheets

INTEGRAL HEATING AND COOLING UNIT

FIELD OF THE INVENTION

The present invention relates generally to an integral heating and cooling unit and, more particularly to a unit integrating electric heating elements and a cooling heat exchanger.

BACKGROUND OF THE INVENTION

Many applications in manufacturing and other fields require controlling the temperature of a fluid. For example, in the field of plastics, the temperature for the dies used for injection molds must be carefully controlled. A heat transfer or working fluid is used to bring the dies to an elevated temperature. Sometimes, the temperature must be rapidly reduced to properly facilitate the injection molding process. In this instance, the working fluid must be quickly cooled. To heat and cool the working fluid for the dies, a separate heater and cooling heat exchanger may be used to control the temperature of the working fluid.

The common approach in the prior art to create a system that both heats and cools a working fluid typically involves plumbing or connecting a heater to a cooler. FIG. 1 illustrates a system 10 that is capable of heating and cooling a working fluid. A heater unit 40 is plumbed or piped to a cooling unit 50 to achieve both heating and cooling of a working fluid 12 according to the prior art. The working fluid 12, such as a heat transfer fluid or oil, enters the system 10 via a pipe 20. The pipe 20 connects to the heating unit 40, which includes a heating element 42. The connection of the pipe 20 to the heating unit 40 involves a joint or weld 30 to assemble. The working fluid 12 passes through the heating unit 40 where heat from the heating element 42 elevates the temperature of the fluid 12.

The working fluid 12 then leaves the heating unit 40 via a plumbing pipe 22. The plumbing pipe 22 brings the heated working fluid 12 to a cooling unit 50. One type of cooling unit 50 is a heat exchanger that uses a cooling fluid 52 to drop the temperature of the working fluid 12. The plumbing of the heating unit 40 to the cooling unit 50 with the pipe 22 involves additional joints or welds 31, 32 to assemble. The cooling fluid 52, such as water, enters the cooling unit 50 via a pipe 54. The connection of the pipe 54 to the cooling unit 50 also involves a joint or weld 33 to assemble.

In the cooling unit 50, heat from the working fluid 12 may transfer to the cooling fluid 52 depending on the heat transfer characteristics of the cooling unit 50 and the mass flow rates of the two fluids 12, 52. The working fluid 12 then leaves the cooling unit 50 via pipe 24, and the cooling fluid 52 leaves the heat exchanger through a pipe 56. The connections of the pipes 24, 56 to the heat exchanger 50 also involves joints or welds 34, 35 to assemble.

The difficult assembly of all of the components and the space required for those components presents one problem in the prior art system 10 that both heats and cools. Plumbing the heater unit 40 to the cooling unit 50 affects the number of components and amount of piping required in assembling the system 10. The increased number of components also multiplies the number of joints or welds 30–35 required, which in turn results in a greater potential for leaks to occur. Additional insulation of the system may be necessary with the increased amount of piping. Similarly, the increased number of components also adds to the cost for the system 10.

The present invention is directed to overcoming, or at least reducing the effects of, one or more of the problems set forth above.

SUMMARY OF THE INVENTION

To that end, the present invention includes an integral heating and cooling unit for controlling the temperature of a working fluid. The heating and cooling unit has an outer housing, at least one electric heating element, and a cooling heat exchanger. The outer housing defines a plenum and has a working fluid inlet, a working fluid outlet, a cooling fluid inlet, and a cooling fluid outlet. The working fluid inlet and outlet are in fluid communication with the plenum. The electric heating element is attached to the outer housing and extends into the plenum to heat the working fluid. The cooling heat exchanger is attached to the outer housing and extends through the plenum to cool the working fluid. The cooling heat exchanger is capable of receiving a cooling fluid from the cooling fluid inlet and sending the cooling fluid to the cooling fluid outlet.

The outer housing may further include a first flange, a second flange, and a tubular shell. In this embodiment, the tubular shell slides over the flanges and is welded to the outer perimeter of the flanges. The cooling heat exchanger may have a variety of designs. In one design, the cooling heat exchanger includes a tube and a plurality of longitudinal fins. The tube is attached to the first and second flanges. In a second design, the cooling heat exchanger includes a tube that is at least partially corrugated. The tube (with corrugations) is attached to the first and second flanges. In yet a third design, the cooling heat exchanger includes a spiral tube having two ends. The ends of the spiral tube are attached to the first and second flanges. In a fourth design, the inlet and outlet of the cooling heat exchanger are attached to the same flange. The cooling heat exchanger is coiled and extends within the outer housing.

In another embodiment, the present invention includes an integral heating and cooling unit for controlling the temperature of a working fluid. However, in this embodiment, the heating and cooling unit has an inverse arrangement of the heating and cooling function. The heating and cooling unit has an outer housing, a heat exchanger, and at least one electric heating element. The outer housing defines a plenum and has a working fluid inlet, a working fluid outlet, a cooling fluid inlet, and a cooling fluid outlet. The cooling fluid inlet and the cooling fluid outlet are in fluid communication with the plenum. The heat exchanger is attached to the outer housing and extends through the plenum. The heat exchanger is capable of receiving the working fluid from the working fluid inlet and sending the working fluid to the working fluid outlet. The electric heating element extends within the heat exchanger and is capable of heating the working fluid.

Another embodiment of the present invention includes a system for heating and cooling a working fluid. The system includes a controller, a working fluid flow control means, and a heating and cooling unit. The working fluid flow control means is electrically connected to the controller to control the flow of the working fluid. The heating and cooling unit has an outer housing, at least one electric heating element, and a cooling heat exchanger. The outer housing defines a plenum to carry the working fluid. The electric heating element is mounted to the outer housing and electrically connected to the controller. The electric heating element extends into the plenum and is capable of heating the working fluid. The cooling heat exchanger is mounted to the outer housing and extends through the plenum. The cooling heat exchanger is capable of cooling the working fluid.

The system may further include a cooling fluid flow control means that is electrically connected to the controller to control the flow of a cooling fluid. The outer housing of the heating and cooling unit has a working fluid inlet, a working fluid outlet, a cooling fluid inlet, and a cooling fluid outlet. The cooling heat exchanger is capable of receiving the cooling fluid from the cooling fluid inlet and sending the cooling fluid to the cooling fluid outlet. The outer housing may further include a first flange, a second flange, and a tubular shell. The tubular shell is attached to the first and second flanges. The heat exchanger for the system may also have several designs including a tube with fins, a tube that is at least partially corrugated, and a tube that is at least partially spiral or coiled.

In another embodiment of the present invention, the system may have a heating and cooling unit with an inverse arrangement of the heating and cooling functions. For instance, the system has a controller, a working fluid flow control means, and a heating and cooling unit. However, the heating and cooling unit has an outer housing, a heat exchanger, and at least one electric heating element. The outer housing defines a plenum for carrying a cooling fluid. The heat exchanger carries the working fluid and extends through the plenum to cool the working fluid. The electric heating element is mounted within the heat exchanger and capable of heating the working fluid.

In yet another embodiment, the present invention includes a method for assembling a heating and cooling unit that is capable of controlling the temperature of a working fluid. The method includes the steps of: providing a first and second flange where the flanges have a plurality of holes; providing a heat exchanger tube; welding the heat exchanger tube to the first and second flanges; providing a plurality of heating elements; welding the plurality of heating elements to the first flange; providing a tubular shell; sliding the tubular shell over the outer perimeter of the first and second flanges; and welding the tubular shell to the first and second flanges. The heat exchanger tube may have several designs including a tube with fins, a tube that is at least partially corrugated, and a tube that is at least partially spiral.

The above summary of the present invention is not intended to represent each embodiment, or every aspect of the present invention. This is the purpose of the figures and detailed description that follows.

BRIEF DESCRIPTION OF THE DRAWINGS

Other objects and advantages of the invention will become apparent upon reading the followed detailed description and upon reference to the drawings.

The foregoing and other aspects of the present invention will be best understood with reference to a detailed description of specific embodiments of the invention, which follows, when read in conjunction with the accompanying drawings, in which.

Figure 1:
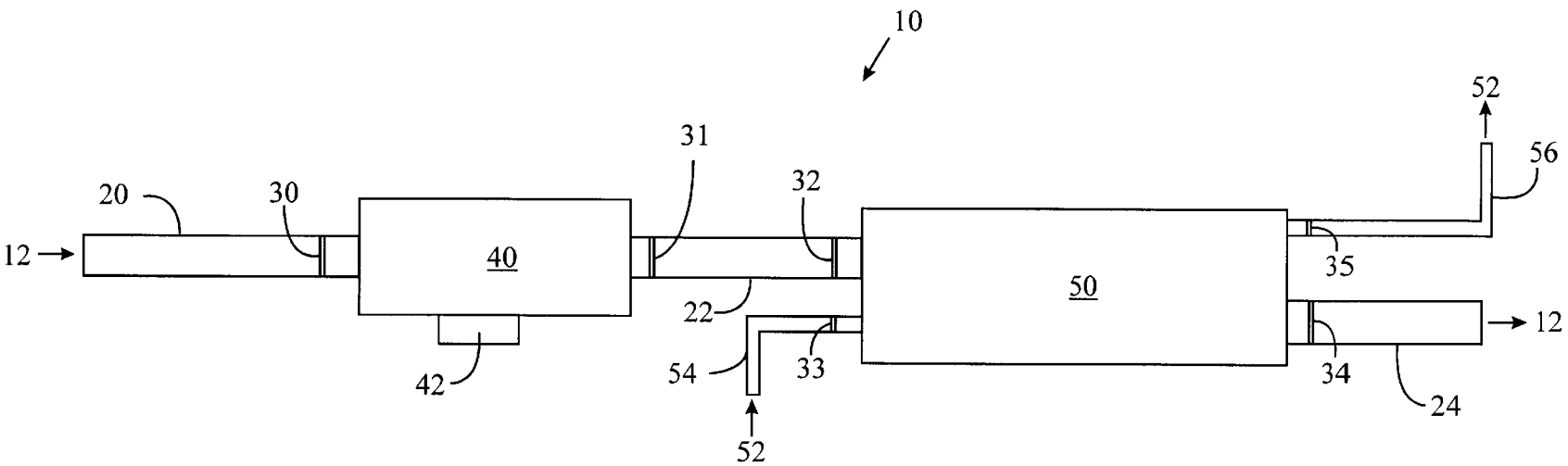
FIG. 1 illustrates a prior art system capable of heating and cooling a working fluid.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modification, equivalents and alternatives falling within the scope of the invention as defined by the appended claims.

DETAILED DESCRIPTION OF THE INVENTION

Figure 2:
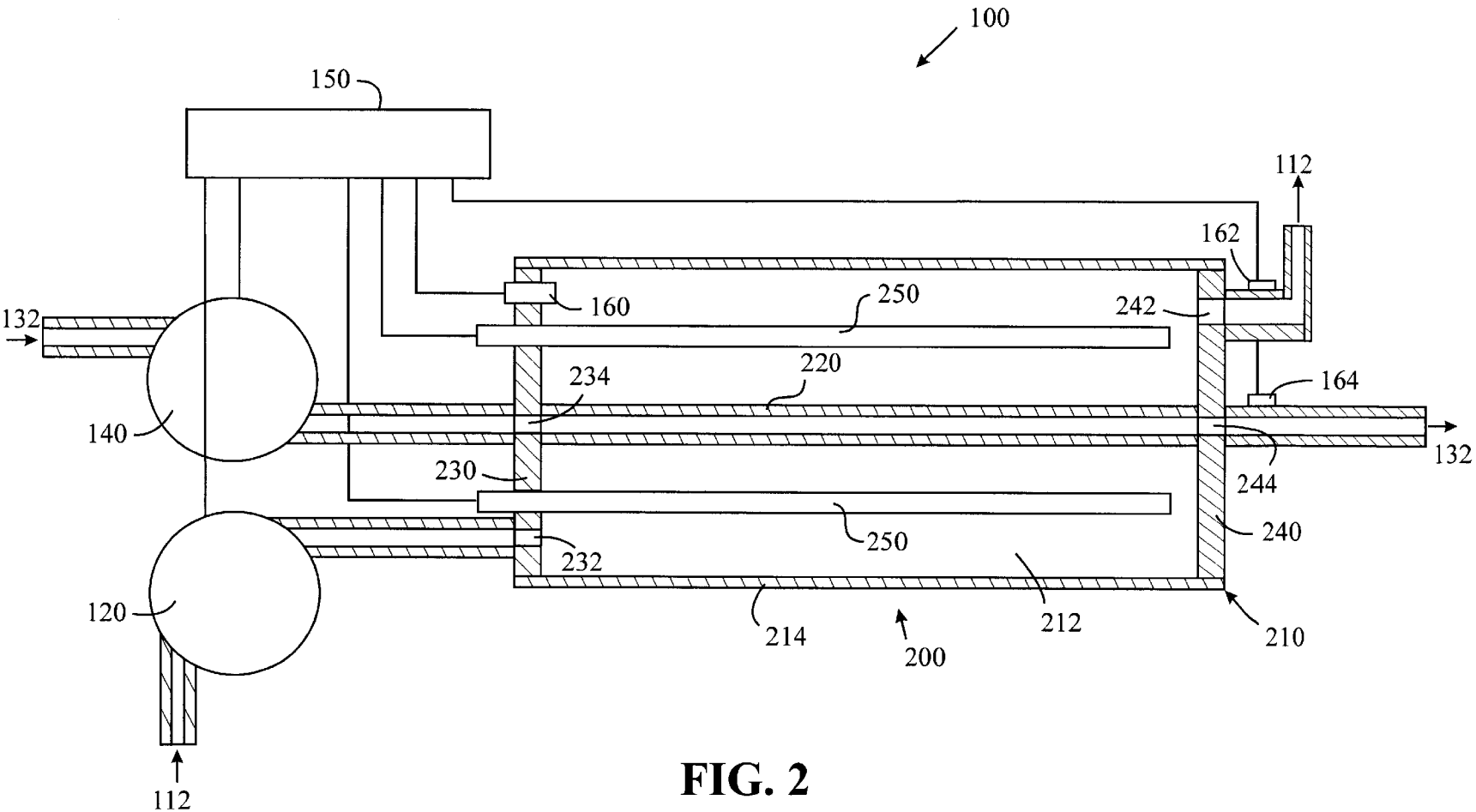
FIG. 2 illustrates a schematic cross-sectional view of a system having an integral heating and cooling unit according to the present invention.

Illustrative embodiments will now be described with reference to the accompanying Figures. FIG. 2 illustrates a schematic cross-sectional view of a system 100 for heating and cooling a working fluid 112. The system 100 operates as part of an overall process where the working fluid 112 must be both heated and cooled. As stated previously, one such process involves the heating and cooling of a heat transfer fluid for controlling the temperature of injection molding dies for plastics. The working fluid 112, such as a heat transfer fluid or oil, flows through the system 100, where it may be heated and cooled independently or in tandem. Once modified, the working fluid 112 travels out of the system 112 to a further portion of the process (not shown), such as heating the dies of an injection molding process.

In one embodiment, the system 100 includes an integral heating and cooling unit 200, a controller 150, flow control means 120, 140, and sensors 160, 162, 164. The integral heating and cooling unit 200 is used to heat and cool the working fluid 112. The integral heating and cooling unit 200 combines the functions of a circulation heater and a heat exchanger. Accordingly, the integral heating and cooling unit 200 has an outer housing 210, a heat exchanger 220, and heating elements 250. In one embodiment, the outer housing 210 defines a plenum 212 and includes a shell 214, an inlet flange 230 and an outlet flange 240. The heat exchanger 220 extends through the plenum 212. The heating elements 250 are attached to the outer housing 210 and extend into the plenum 212.

During operation of the system 100, the working fluid 112 enters the system 100 from a source (not shown) via external piping. A working fluid flow control means 120 may be used to control the movement of the working fluid 112 through the system 100. The working fluid flow control means 120 may include a pump, a valve, a motor or other means. The working fluid 112 then enters the integral heating and cooling unit 200 through a first inlet 232 in the inlet flange 230. Once inside the integral heating and cooling unit 200, the working fluid 112 circulates in the plenum 212 and contacts the heating elements 250. In this way, the plenum 212 acts as a circulation heater where heat transfers from the heating elements 250 to the working fluid 112 depending on the fluid flow and the power to the heating elements 250.

In the plenum 212, the working fluid 112 also contacts the heat exchanger 220. The working fluid 112 thus comes into heat transfer relation with both the heat exchanger 220 and the heating elements 250. Depending on the flow of a cooling fluid 132 in the heat exchanger pipe 220, the working fluid 112 expels heat through the heat exchanger 220 to the cooling fluid 132. The modified working fluid 112 then leaves via a first outlet 242 in the outlet flange 240 and may then pass to further portions of the process (not shown).

In another aspect of the operation of the system 100, the cooling fluid 132, such as a heat transfer fluid or water, enters the system 100 via external piping. The cooling fluid 132 may come from a chiller or condenser (not shown). A cooling fluid flow control means 140 for controlling the movement of the cooling fluid 132 through the system 100 may also be provided. For example, the cooling fluid 132 may have existing head pressure and a solenoid valve may open to allow the cooling fluid 132 to enter the system 100. Alternatively, a pump may be used to move the cooling fluid 132 through the system 100.

The cooling fluid 132 enters the integral heating and cooling unit 200 through a second inlet 234 in the inlet flange 230. The cooling fluid 132 passes through the heat exchanger 220 and comes into heat transfer relation with the working fluid 112 in the plenum 212. The cooling fluid 132 then leaves via a second outlet 244 in the outlet side 240. The modified cooling fluid 132 may then pass to a chiller of condenser (not shown) to expel heat to an external heat sink.

A controller 150 is electrically connected to the flow control means 120 and 140, heating elements 150, and a plurality of sensors 160, 162, and 164. Those of ordinary skill in the art will recognize that the controller may include relays, contactors and other circuitry to operate the system 100 and may be based on a microprocessor. The controller 150 actuates the flow control means 120, 140 to individually control the flow of the working fluid 112 and cooling fluid 132 within the system 100. To control the flow of the working fluid 112 in the system 100, the controller 150 actuates the flow control means 120 for moving the working fluid 112 through the system 100. The working fluid 112 enters the integral heating and cooling unit 200 through the inlet 232 and passes into the plenum 212 between the heat exchanger 220 and the outer chamber 210.

To generate heat within the plenum 212, the heating elements 250 connect to a power supply from the controller 150. The controller 150 supplies power to the heating elements 250 and regulates the heating of the working fluid 112 in the plenum 212. In one embodiment, a temperature sensor 160 inserts into the inlet flange 230 to measure the temperature of the working fluid 112 in the plenum 212. In the plenum 212, the heat transfer relation of the working fluid 112 with the heating elements 250 defines a heating function for the integral heating and cooling unit 200.

The modified working fluid 112 exits through the outlet 242. The controller 150 may also connect to a sensor 162 located on the outlet of the heating and cooling unit 200, which monitors the flow rate, pressure and/or temperature of the working fluid 112 as it leaves the system 100 and travels further in the process.

To control the flow of cooling fluid 132, the controller 150 actuates the cooling fluid flow control means 140 for moving the cooling fluid 132 through the heat exchanger 220 in the integral heating and cooling unit 200. The cooling fluid 132 enters the integral heating and cooling unit 200 through the inlet 234 and passes through the heat exchanger 220. With cooling fluid 132 passing through the heat exchanger, the heat transfer relation of the cooling fluid 132 with the working fluid 112 in the plenum 212 defines a cooling function of the integral heating and cooling unit 200. The modified cooling fluid 132 exits through the outlet 244. The controller 150 may connect to a sensor 164 located on the outlet of the heating and cooling unit 200, which monitors the flow rate, pressure and/or temperature of the cooling fluid 112 and maintains certain mass flow rates.

The integral heating and cooling unit 200 juxtaposes the operation of the heating function with that of the cooling function. The heating and cooling functions may operate independently or in tandem. First, the heating function may be operated alone. For example, one or more of the heating elements 250 may be supplied power to heat the working fluid 112 in the plenum 212. The controller 150 monitors the temperature of the fluid 112 with the sensor 160. The controller 150 further controls the flow of the working fluid by monitoring the fluid 112 with sensor 162 and actuating the flow control means 120. The controller 150 may not pass the cooling fluid 132 through the heat exchanger 220. In this instance, the integral heating and cooling unit 200 acts as a circulation heater to elevate the temperature of the working fluid 112.

Alternatively, the cooling function may operate alone. The heating elements 250 may be turned off by the controller 150 and the cooling fluid 132 passed through the heat exchanger 220. The cooling fluid 132 extracts heat from the working fluid 112 in the plenum 212. In this instance, the integral heating and cooling unit 200 acts strictly as a heat exchanger between the two fluids 112, 132.

Still further, the integral heating and cooling unit 200 juxtaposes the operation of the heating function with the cooling function by operating the heating and cooling functions in tandem. More specifically, the cooling function works in conjunction with the heating function to control the temperature of the working fluid 112. For example, the heating elements 250 may continuously heat the working fluid 112 flowing in the plenum 212. The cooling fluid 132 may simultaneously pass through the heat exchanger 220 to extract heat from the working fluid 112.

The controller 150 monitors the temperatures and mass flow rates of the fluids and actuates the flow control means 120, 140 for moving the fluids 112, 132. By monitoring and controlling the fluids in tandem, the controller 150 ensures that the temperature and mass flow rate of the working fluid 112 meet the requirements of the process as it leaves the system 100. In this instance, the integral heating and cooling unit 200 acts as a circulation heater with a concomitant heat exchanger to control or modulate the temperature of the working fluid 112.

The integral heating and cooling unit 200 of the present invention may have many different configurations based on the specific applications to which it is intended. For example, it is understood that the number and design of electric heating elements may vary to achieve specific temperature levels or to allow for specific mass flow rates of the working fluid 112 within the plenum 212. Likewise, the heat exchanger 220 may consist of many tubes or a spiraling tube in addition to other embodiments in order to increase the surface area and the heat transfer capability of the heat exchanger 220. The heat exchanger 220 may involve cross-flow or counter-flow, besides the parallel-flow described herein. Moreover, the heat exchanger 220 may be integrally formed outside of the outer housing 210 in an inverse configuration, or the physical location of the heat exchanger 220 to the heating elements 250 may also vary.

Figure 3:
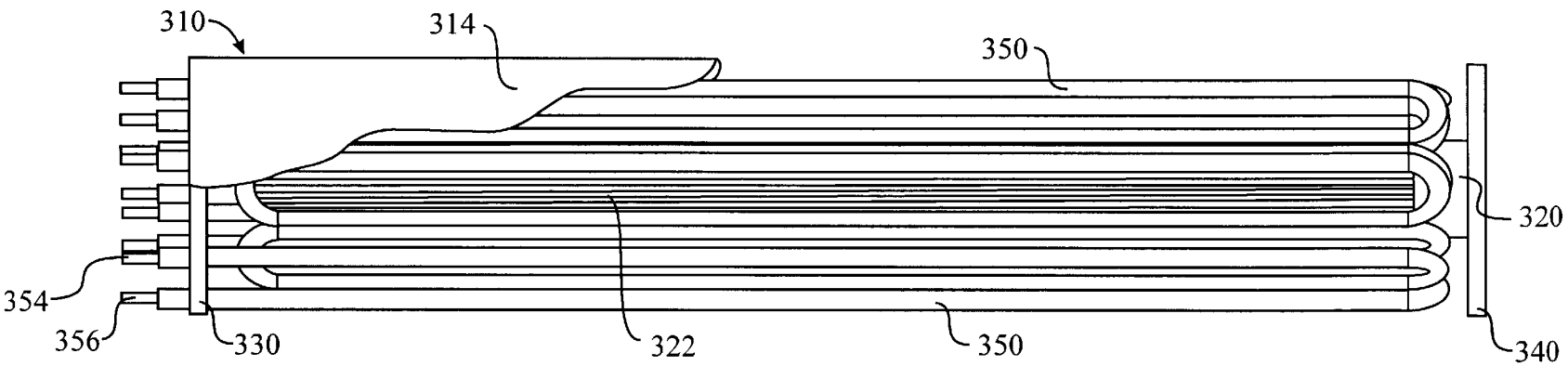
FIG. 3 illustrates a side view of a preferred embodiment of an integral heating and cooling unit according to the present invention.

Referring specifically to the integral heating and cooling unit of the present invention, FIG. 3 illustrates a preferred embodiment of an integral heating and cooling unit 300 with a shell 314 partially cutaway. The integral heating and cooling unit 300 defines a combination heater, heat exchanger and circulation heater all in a seamless vessel or outer housing 310 defining a plenum 312 therein.

The shell 314 in the present embodiment is a hollow cylindrical tube. Two flanges 330, 340 weld to the open ends of the shell 314 to complete the assembly. A heat exchanger pipe 320 having an axial bore (not visible) therethrough situates longitudinally within the shell 314. The pipe 320 may include a plain exterior surface or may further include a plurality of heat exchange fins 322.

The heat exchange pipe 320 connects to the first or inlet flange 330 at one end and connects to the second or outlet flange 340 at the other end of the pipe 320. The inlet and outlet flanges 330, 340 may be of any number of shapes, including round, oval, square or rectangular depending on the shape of the shell 314 and the required application.

Figure 6:
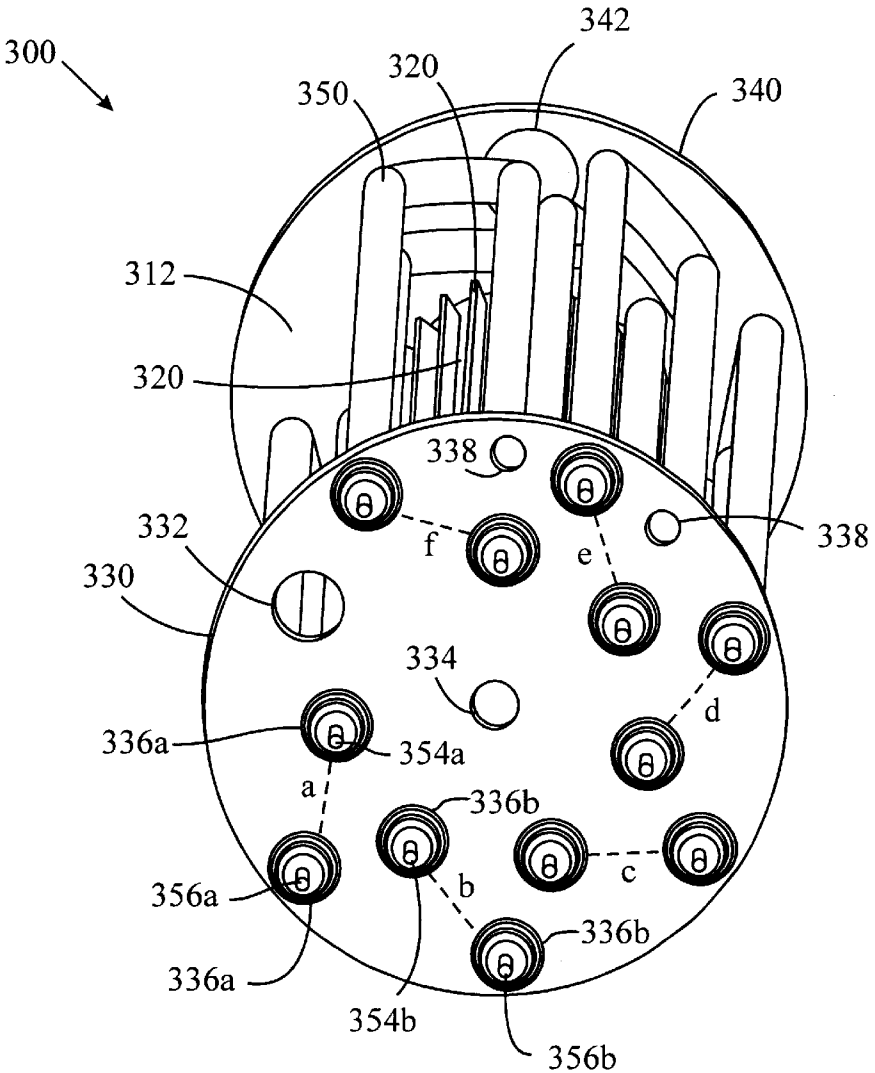
FIG. 6 illustrates an end perspective view of the integral heating and cooling unit of FIG. 3.

Referring to FIGS. 3 and 6, the inlet flange 330 includes a working fluid inlet 332 towards the perimeter of the flange 330. Likewise, the outlet flange 340 includes a working fluid outlet 342 towards the perimeter of the flange 340 and away from the heat exchange pipe 320. The working fluid inlet 332 and the working fluid outlet 342 communicate directly with the plenum 312 within the shell 314. The outlet flange 340 may further include a drain outlet communicating with the plenum 312, which is used to clear the plenum 312 of working fluid when not in use.

The inlet flange 330 further includes a cooling fluid inlet 334, which aligns with the axial bore of the heat exchange pipe 320. The outlet flange 340 also includes a cooling fluid outlet 344 (not visible), which also aligns with the axial bore of the heat exchange pipe 320. The cooling fluid inlet 334 and the cooling fluid outlet 344 communicate directly with the heat exchange pipe 320.

The plenum 312 (within outer housing 310) further contains a plurality of heating elements 350 situated therein. In one embodiment, the heating elements 350 connect to one of the flanges (here, the inlet flange 330) by a plurality of holes 336*a–f* therein and situate around the pipe 320 within the plenum 312. In particular, each of the heating elements 350 includes a first termination 354*a–f* and a second termination 356*a–f* attached to one of the holes 336*a–f*. The terminations 354*a–f*, 356*a–f* project outside the heating and cooling unit 300 for connection to a power source (not shown). Also in the inlet flange 330, a plurality of holes 338 may be provided for the addition of temperature sensors and fluid probes (not shown).

To provide representative dimensions and values related to the preferred embodiment, the integral heating and cooling unit 300 may have a length of approximately 30 inches and a diameter of approximately 8 inches. The heating elements 350 may provide an example heating capacity of 24 kW each, while the cooling capacity of the heat exchanger 220 may be approximately 42 kW. The mass flow rate for fluids passing through the integral heating and cooling unit 300 may approach 20 gallons per minute or more.

The present invention offers a number of advantages over conventional techniques of plumbing or piping a cooling unit to a heating unit. More than simply interconnecting a heater with a heat exchanger, the integral heating and cooling unit 300 contains an electric heater and heat exchanger all inside a single unit. As such, the integral heating and cooling unit 300 provides more efficient heating and cooling capacities by juxtaposing the heating and cooling functions. The close proximity of the heating and cooling functions minimizes heating and cooling loses when the functions operate separately or in tandem. Furthermore, the heat exchanger 320 locates adjacent to the maximum amount of working fluid, thus providing maximum cooling.

Another advantage of the integral heating and cooling unit 300 is the conservation of space. The integral heating and cooling unit 300 defines a single unit that holds a heat exchanger inside a circulation heater. The design of the integral heating and cooling unit 300 eliminates the need for plumbing a heater to a cooler. Having both the heater and the heat exchanger incorporated together in the integral heating and cooling unit 300 eliminates the piping to join them. The elimination of additional piping greatly reduces the potential for leaks to occur. The design reduces the number of parts and is lighter than requiring two separate assemblies. The entire heating and cooling unit 300 defines one seamless unit and is designed to be a disposable item should replacement be required.

Due to the simplified construction, the cost for assembly is comparable to a replacement immersion heater. For a brief example of the assembly, the flanges 330, 340 are predrilled with access holes for future connections of tubing and heating elements. The flanges 330, 340 weld to each end of the heat exchanger pipe 220. The heating elements 350 are attached to holes 336*a–f* of the flange 330 and welded into place. Alternatively, the heating elements 350 may be screw plug type heaters and threaded into holes in the flange 330. The shell 314 slides over the assembly, and the flanges 330, 340 weld thereto. In one embodiment, the shell 314 is a seamless tube to reduce the chances of leaks.

The welding of the flanges 330, 340 to the shell 314 seals the plenum 312. The inlet tubing (not shown) welds to the inlets 332, 34 on the inlet flange 330, and the outlet tubing (not shown) welds to the outlets 342, 344 on the outlet flange 340. All the welds to the inlets 332, 334 and outlets 342, 344 are located on the flat surfaces of the flanges 330, 340, which simplifies the mating of the parts. The inlets 332, 334 and outlets 342, 344 in flat surfaces of the flanges 330, 340 also minimizes the number of joints and total parts for the present invention.

Figure 4A:
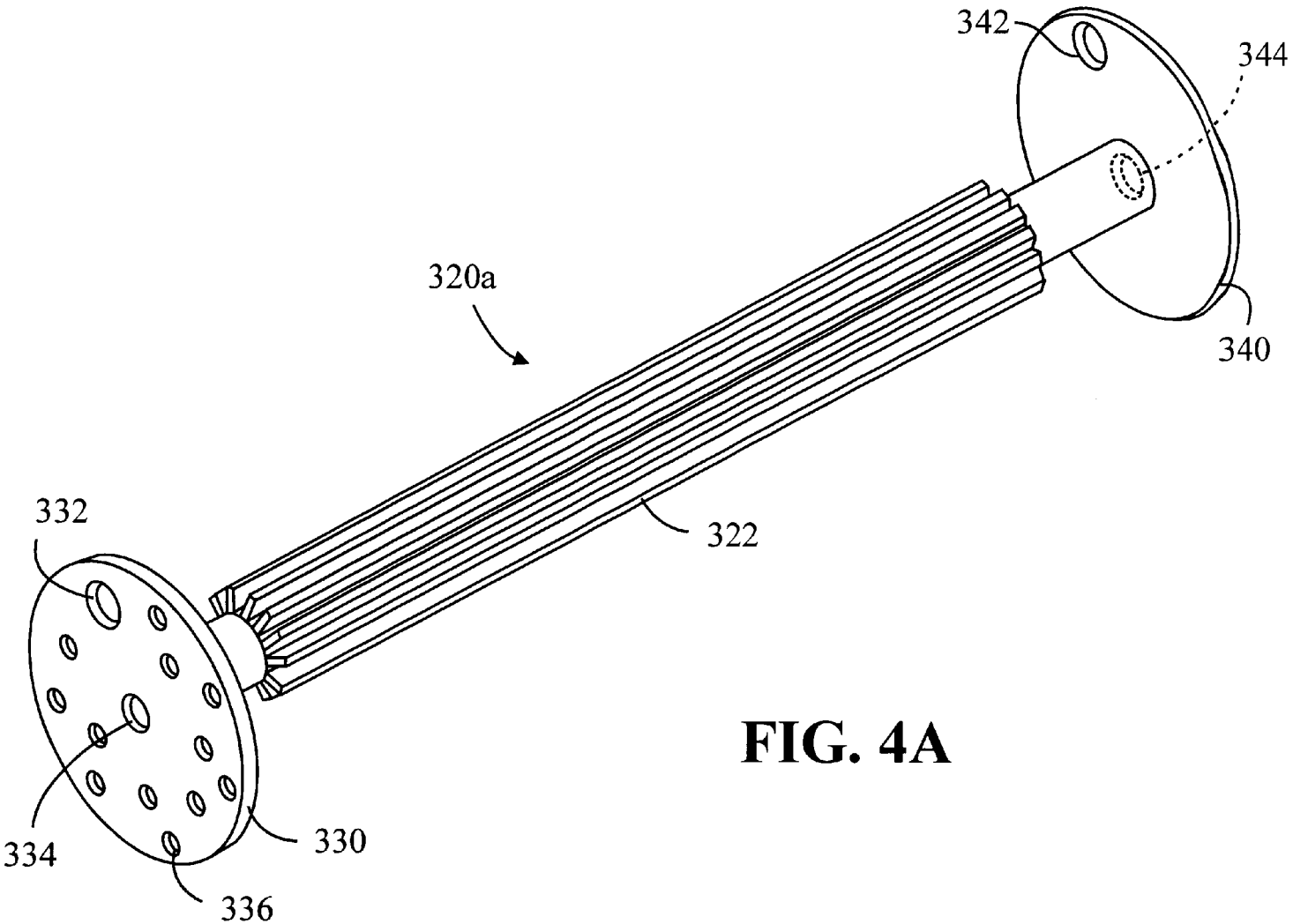
FIGS. 4A–4D illustrate perspective views of embodiments of heat exchangers that may be used for the integral heating and cooling unit.

Referring specifically to the heat exchanger 320 of the present embodiment, FIG. 4A illustrates an embodiment of a heat exchanger 320*a* with attached flanges 330, 340. In an effort to reduce difficulties in assembly, the cooling function uses only one part, i.e., the heat exchanger pipe 320*a*. Each end of the pipe 320*a* welds to a flange 330, 340. The heat exchanger pipe 320*a* defines a tube having a plurality of longitudinal fins 322 running along the exterior surface of the pipe 320*a*. The longitudinal fins 322 increase the surface area of the heat exchanger pipe 320*a* and improve its heat transfer capability.

Figure 4B:
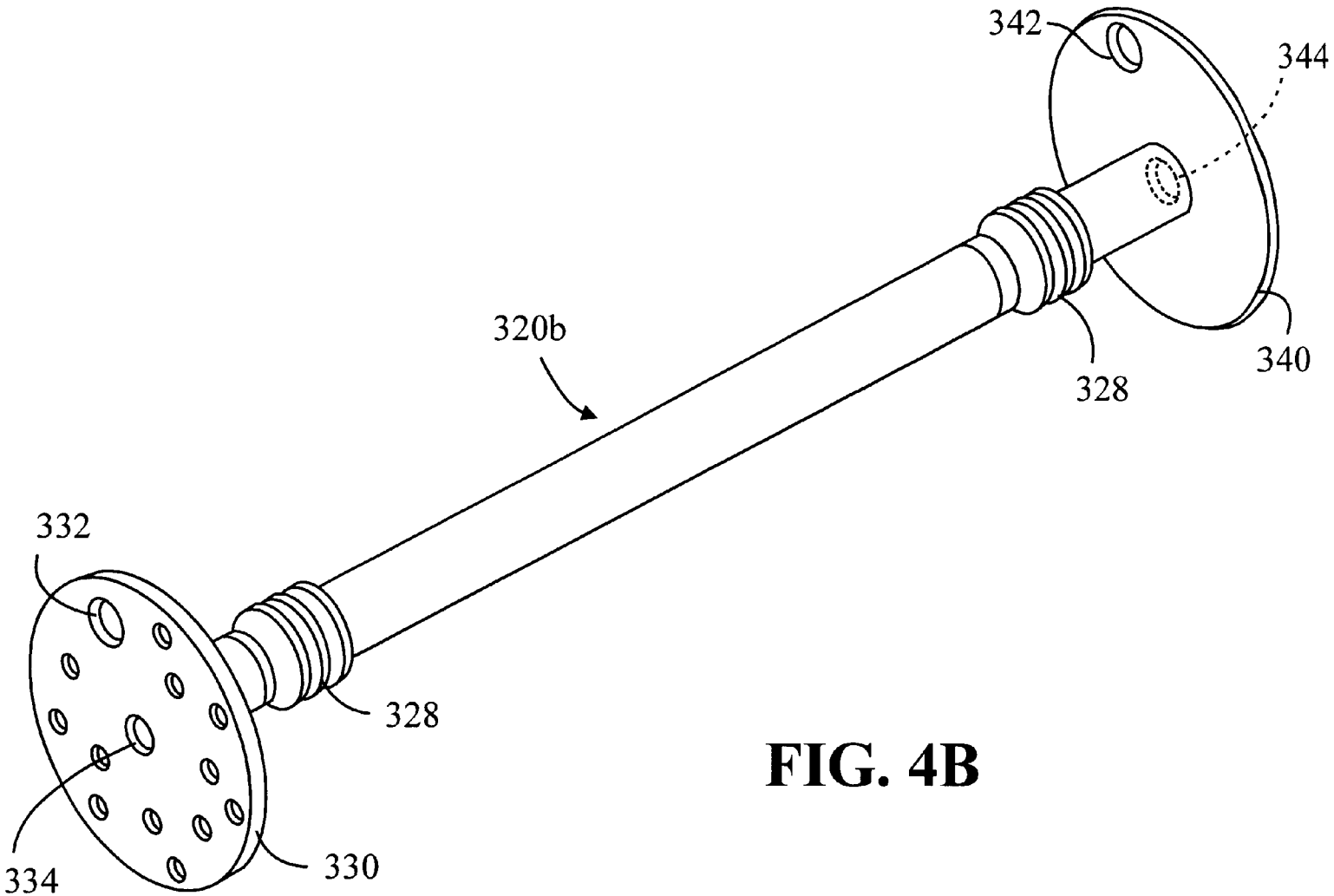

As seen in FIG. 4A, the rigid heat exchanger pipe 320*a* with longitudinal fins 322 could present a problem with thermal expansion and contraction depending on the specific application. Under certain conditions, the expansion and contraction of the heat exchanger pipe 320*a* could compromise the integrity of the integral heating and cooling unit 300. Specifically, leaks could develop in the welds between the pipe 320*a* and the flanges 330, 340 or between the flanges 330, 340 and the shell 314. Accordingly, referring to FIG. 4B, another embodiment of a heat exchanger pipe 320*b* uses corrugated, flexible tubes. The corrugations 328 along the pipe 320*b* allow for thermal expansion and contraction of the pipe 320*b* due to changes in temperature. The corrugations 328 also give additional surface area to the pipe 320*b* for heat transfer.

Figure 4C:
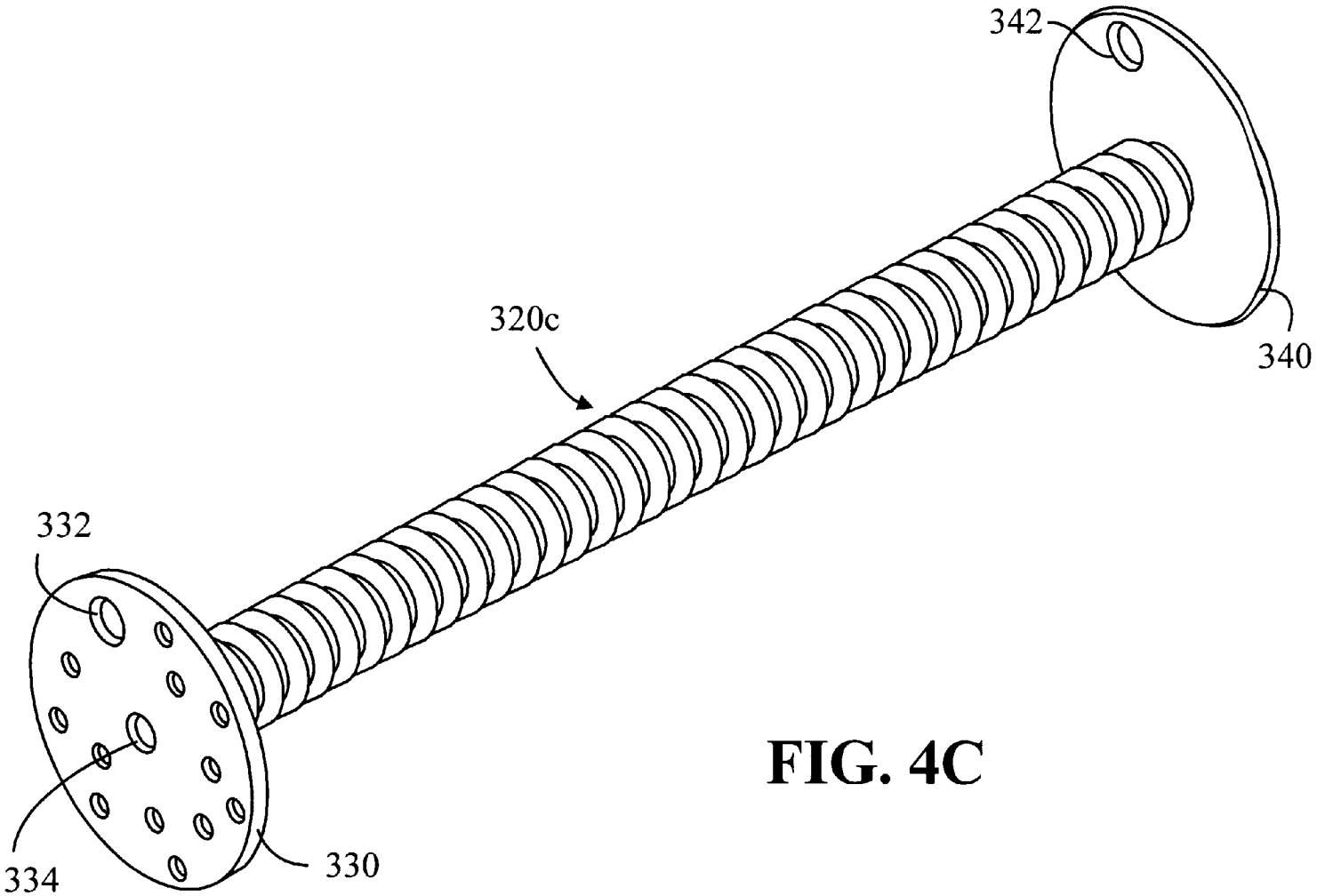

Referring to FIG. 4C, yet another embodiment of a heat exchanger pipe 320*c* defines a spiraling tube having a thin metal wall. Each end of the pipe 320*c* welds to flanges 330, 340. The spiraling tube 320*c* greatly increases the surface area of the pipe 320*c* and improves its heat transfer capability. To provide representative values, the tube 320*c* may span a length of approximately 30 inches and spiral in 40–50 revolutions. The tube 320*c* creates a helix with an outside diameter between 2–3 inches. The surface area for the pipe 320*c* could be approximately 3–4 square feet, which greatly increases the heat transfer capability.

Figure 4D:
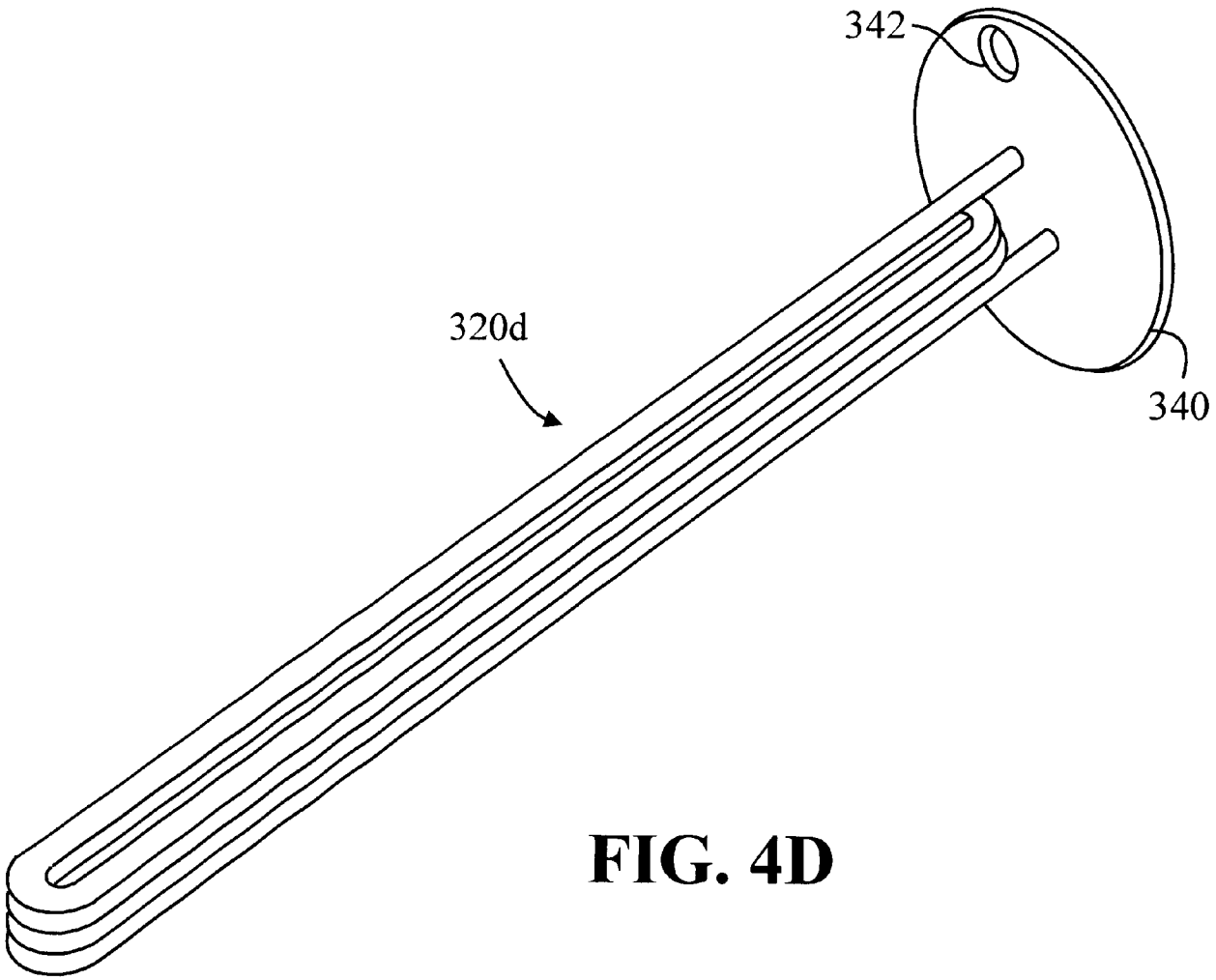

Referring to FIG. 4D, another embodiment of a heat exchanger pipe 320*d* is defined by a coiled or wrapped tube having a thin metal wall. Unlike the embodiment in FIG. 4C, in this embodiment each end of the pipe 320*d* is welded or otherwise attached to only one flange 330 or 340. The coiled or wrapped tubing greatly increases the surface area of the pipe 320*d* and improves its heat transfer capability. Moreover, the coiled design permits some decrease of thermal expansion within the plenum.

Figure 5:
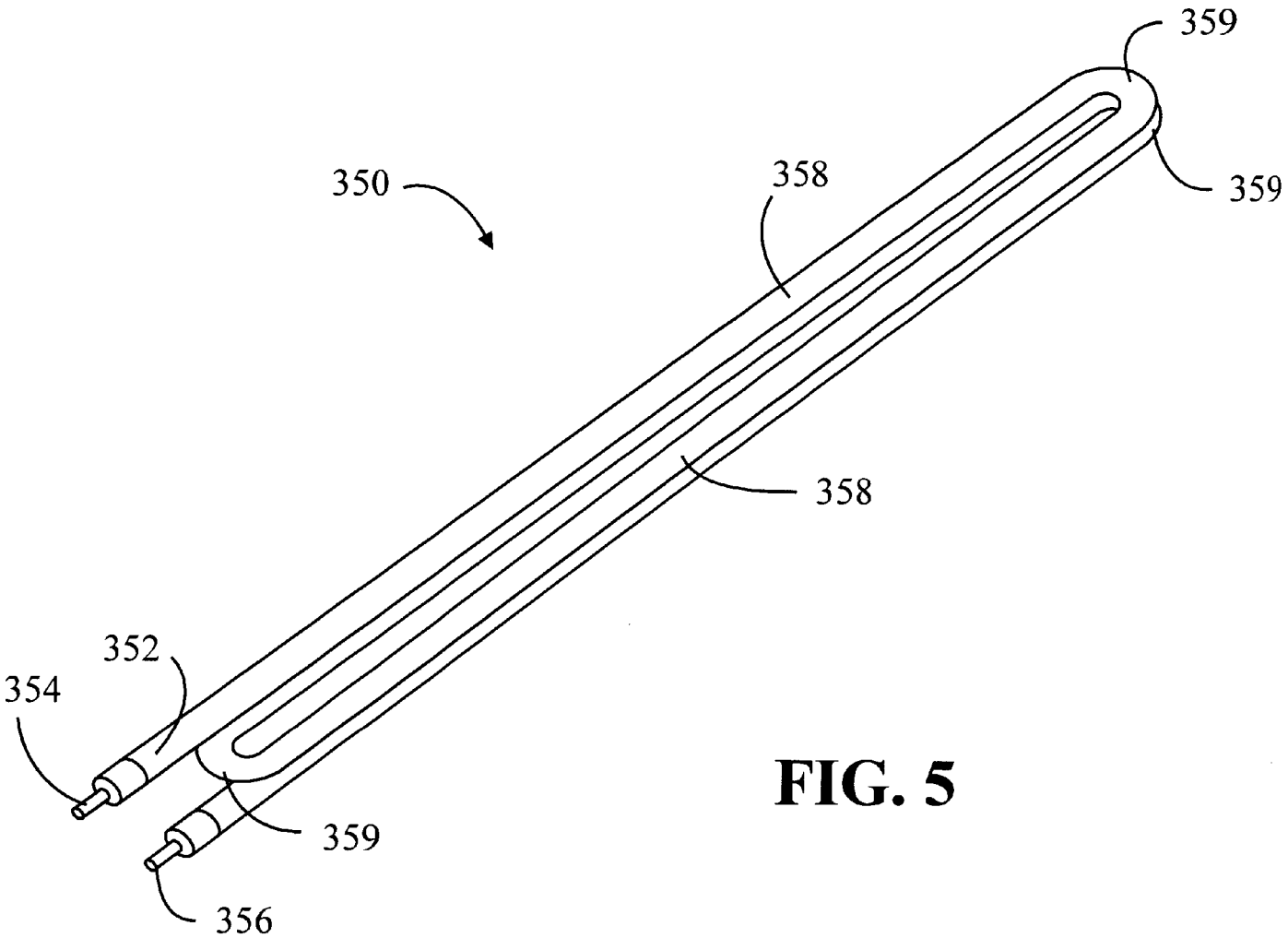
FIG. 5 illustrates a perspective view of an embodiment of a tubular heating element that may be used for the integral heating and cooling unit.

Referring specifically to the heating elements 350 of the present embodiment, FIG. 5 illustrates a perspective view of an embodiment of a heating element 350. The heating element 350 defines a tubular electric element 352 in which a current passing through generates heat. The tubular element 352 has a first termination 354 and a second termination 356. From the first termination 354, the tubular element 352 extends in a longitudinal portion 358. A bend or fold-back 359 returns the tubular element 352 in another parallel, longitudinal portion 358. A further plurality of bends 359 and parallel, longitudinal portions 358 wind the tube 352 to the second termination 356. The winding tubular element 352 forms an elongated, compact heating coil, which is ideal for placement in the plenum 312 of the heating and cooling unit 300 of FIG. 3.

The winding bends 359 and parallel, longitudinal portions 358 of the heating element 350 increases the surface area to provide heating. The winding heating element 350 further reduces the number of heaters required for the heating and cooling unit 300. Thus, the number of terminations and buss bars is reduced on the heating and cooling unit 300 and the wiring scheme is simplified.

Referring to FIG. 6, an end view of the heating and cooling unit 300 of FIG. 3 reveals a preferred arrangement for the access holes and the tubular heating elements. The inlet flange 330 is predrilled with access holes 332, 334 for future fluid connections. The working fluid inlet 332 lies towards the perimeter of the flange 330 and communicates with the plenum 312 in which the heating elements 350 situate. The cooling fluid inlet 334 lies towards the center of the flange 330 and communicates with the heat exchanger pipe 320 passing through the plenum 312.

The outlet flange 340, positioned at the other end of the pipe 320, also has predrilled access holes for future fluid connections. The outlet flange 340 includes the working fluid outlet 342 lying towards the perimeter of the flange 340 and includes the cooling fluid outlet (not visible) situated towards the center of the flange 340.

The integral heating and cooling unit 300 assumes a particular horizontal arrangement. Most notably in the present view, the working fluid outlet 342 always positions towards the top of the horizontal arrangement. In this position the working fluid outlet 342 provides the integral heating and cooling unit 300 with an automatic vent or purge feature. When the plenum 312 is first filled with working fluid, the position of the working fluid outlet 342 towards the top of the outlet flange eliminates the necessity to bleed the plenum 312 of air. The design eliminates the need to include additional ports for bleeding air from the plenum 312.

The end view of the heating and cooling unit 300 in FIG. 6 further reveals a preferred arrangement for the heating elements 350. The inlet flange 330 includes a plurality of holes 336*a–f* for attachment of the heating elements 350. Also, a plurality of holes 338 provides for the insertion of temperature probes or sensors (not shown) into the plenum 312. The heating elements 350 weld into the plurality of holes 336*a–f* in a special pattern. Primarily, the pattern allows access for the fluid connections 332, 334 in the inlet flange 330 and also provides room for the probes in the access holes 338.

The present embodiment includes six heating elements 350 welded to the access holes 336*a–f* in the inlet flange 330. Each heating element 350*a–f* has two terminations 354*a–f*, 356*a–f* that install in the access holes 336*a–f*. The heating elements 350 mount to the flange 330 in a manner to maximize their coverage in the plenum 312: however; the heating elements 350 are not symmetrically spaced around a 360-degree circle. The spacing is limited to less than 360° to allow room for the fluid connections 332, 334, the sensor holes 338 and the heat exchange pipe 320. Also, each heating element 350, as it is spaced around the flange 330, is further provided with a slight degree of tilt with respect to the perimeter of the flange 330. This preferred arrangement of the heating elements 350*a–f* enhances the fluid velocity within the plenum 312 and improves the heat transfer from the heating elements 350*a–f* to the working fluid in the plenum 312. It is also understood that the heater elements may be screw plug type elements. In such a case, the base of the screw plug is threaded into holes of the flange 330.

Figure 7:
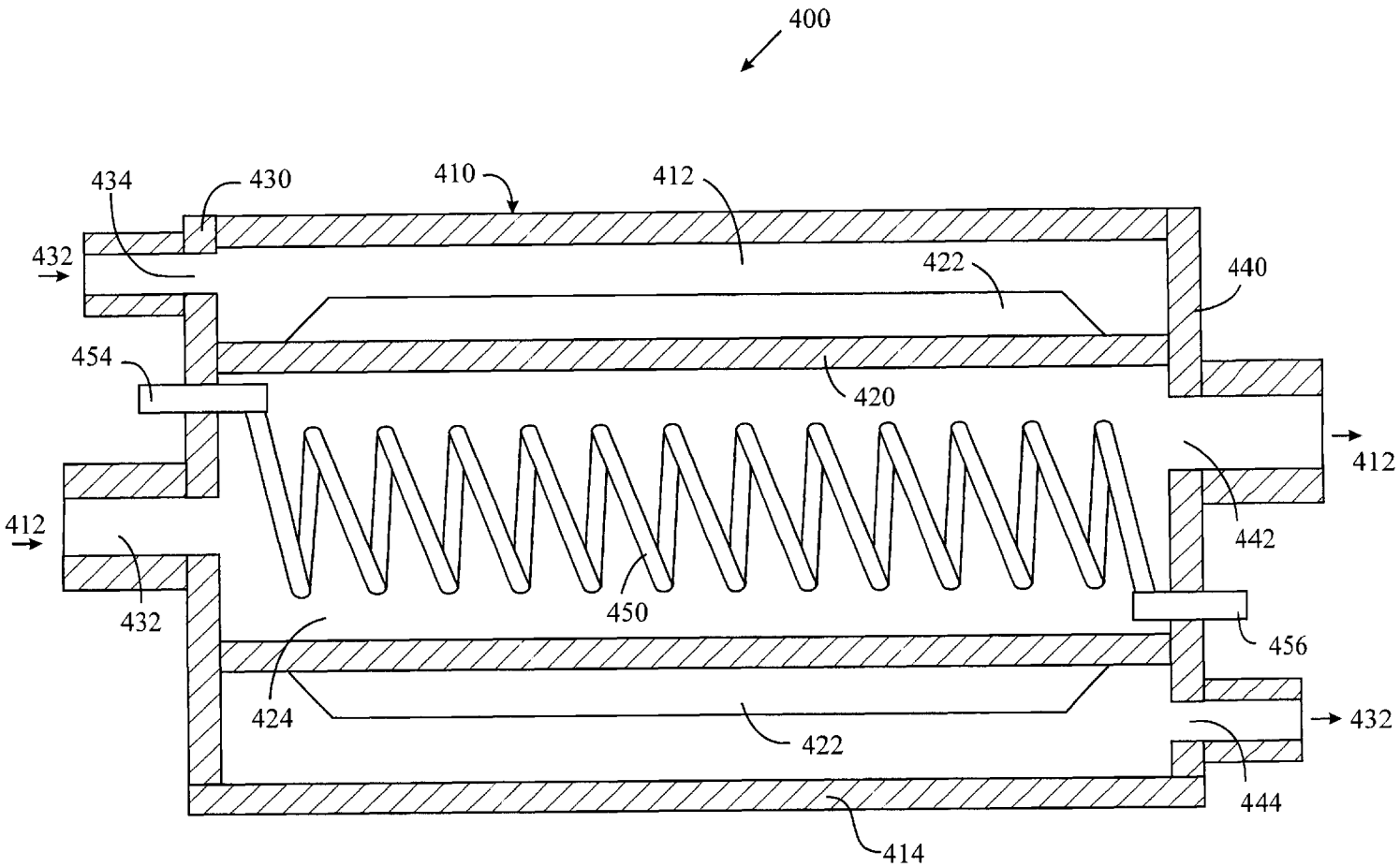
FIG. 7 illustrates a schematic cross-sectional view of another embodiment of a integral heating and cooling unit according to the present invention.

FIG. 7 illustrates another embodiment of an integral heating and cooling unit 400 according to the present invention. The integral heating and cooling unit 400 is shown in schematic cross-section and represents an inverse arrangement of the heating and cooling functions. An outer housing 410 in the present embodiment defines a hollow plenum 412. In this embodiment, the outer housing 410 includes a shell 414 and flanges 430 and 440. Two flanges 430, 440 weld to the open ends of the shell 414 to close the plenum 412. A heat exchanger pipe 420 having an axial bore 424 therethrough situates longitudinally through the plenum 412. The heat exchanger pipe 420 may include a plain exterior surface or may further include a plurality of fins 422. Alternative, the heat exchanger pipe 420 may have corrugations, spirals, or be coiled.

The inlet flange 430 includes a first fluid inlet 432 towards the center of the flange 430. Likewise, the outlet flange 440 includes a first fluid outlet 442 towards the center of the flange 440. The first fluid inlet 432 and the first fluid outlet 442 communicate directly with the axial bore 424 of the heat exchange pipe 420. The inlet flange 430 further includes a cooling fluid inlet 434, which communicates with the plenum 412. The outlet flange 440 also includes a cooling fluid outlet 444, which also communicates with the plenum 412 of the shell 410.

The axial bore 424 of the heat exchange pipe further contains a spiraling heating elements 450 situated therein. The heating element 450 connects to the inlet flange 430 so that the terminals 454, 456 may connect with a power supply (not shown) outside the heating and cooling unit 400. As before, the heating and cooling functions are juxtaposed in the present embodiment.

To achieve the heating function, a working fluid 412 enters the heating and cooling unit 400 from a source (not shown) through a first inlet 432 in the inlet flange 430. Once inside the integral heating and cooling unit 400, the working fluid 412 travels through the axial bore 424 of the heat exchange pipe 420. In the bore, the working fluid 412 comes into heat transfer relation with both the plenum 412 and the heating element 450. The working fluid 412 then leaves via a first outlet 442 in the outlet flange 440. The modified working fluid 412 may then pass to further portions of a process (not shown).

To achieve the cooling function and to further control the temperature of the working fluid, a cooling fluid 432, such as a heat transfer fluid or water, enters the heating and cooling unit 400 through the second inlet 434 in the inlet flange 430. The cooling fluid 432 passes through the plenum 412 and comes into heat transfer relation with the heat exchange pipe 420. The cooling fluid 432 then leaves via a second outlet 444 in the outlet flange 440. The modified cooling fluid 432 may then pass to a chiller of condenser (not shown) to expel heat to an external heat sink.

Figure 8:
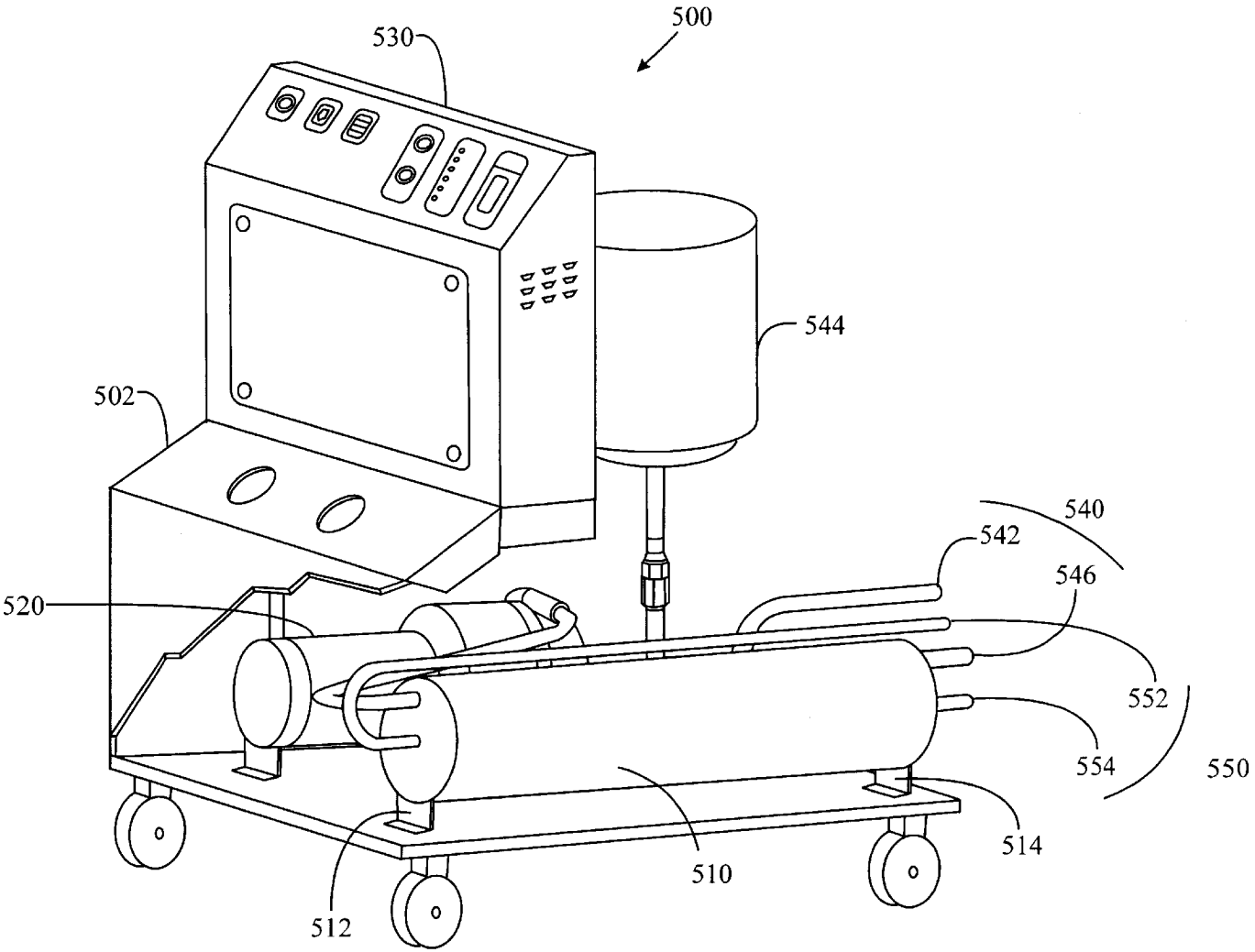
FIG. 8 illustrates a perspective view of a preferred embodiment of a system having an integral heating and cooling unit, a pump, a controller and fluid connections according to the present invention.

FIG. 8 illustrates a further embodiment of a system 500 having an integral heating and cooling unit 510, a working fluid pump 520, a controller 530 and fluid connections 540, 550 according to the present invention. The system 500 includes a cabinet 502, shown partially cut away. Within the cabinet 502, the integral heating and cooling unit 510 mounts horizontally on brackets 512, 514. The fluid connections 540, 550 project from the rear of the cabinet 502.

A first fluid pipe 542 connects to a supply of working fluid (not shown). The working fluid enters the system and may pass into an expansion and contraction tank 544 that allows for thermal expansion and contraction or collection of the fluid. The pump 520, actuated by the controller 530, moves the working fluid to the integral heating and cooling unit 510. The controller 530 connects to a power supply (not shown) and supplies the heating elements (not visible) within the heating and cooling unit with power. A cooling fluid pipe 552 connects to a supply of cooling fluid (not shown). The cooling fluid enters the system 500 and is plumbed to the integral heating and cooling unit 510. To control the flow of cooling fluid within the heating and cooling unit 510, the controller 530 may actuate a pump or valve (not shown).

Inside the integral heating and cooling unit 500, the temperature of the working fluid is modified. The fluid exits the heating and cooling unit 510 through the fluid pipe 546 and proceeds to further portions of a process (not shown). The cooling fluid exits the system 500 through the fluid pipe 554 and may proceed to a chiller or condenser (not shown).

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A heating and cooling unit for controlling the temperature of a working fluid, the heating and cooling unit comprising:

an outer housing defining a plenum, the outer housing having a working fluid inlet, a working fluid outlet, a cooling fluid inlet, and a cooling fluid outlet, the working fluid inlet and the working fluid outlet in fluid communication with the plenum;

at least one electric heating element attached to the outer housing and extending into the plenum, the at least one electric heating element capable of heating the working fluid; and at least one cooling heat exchanger pipe situated longitudinally within the outer housing and extending through the plenum, the cooling heat exchanger pipe having an axial bore extending between first and second ends thereof and connected to the cooling fluid inlet at the first end and to the cooling fluid outlet at the second end, the cooling fluid inlet and the cooling fluid outlet in fluid communication and aligned with the axial bore of the cooling heat exchanger pipe, the cooling heat exchanger pipe capable of receiving a cooling fluid from the cooling fluid inlet and sending the cooling fluid to the cooling fluid outlet.

2. The heating and cooling unit of claim 1, wherein the outer housing includes a first flange, a second flange, and a tubular shell, the tubular shell attached to the first flange and the second flange.

3. The heating and cooling unit of claim 2, wherein the at least one cooling heat exchanger includes a tube and a plurality of longitudinal fins, the longitudinal fins attached to the tube, the tube attached to the first flange and the second flange.

4. The heating and cooling unit of claim 2, wherein the at least one cooling heat exchanger includes a tube, the tube being at least partially corrugated, the tube attached to the first flange and a second flange.

5. The heating and cooling unit of claim 2, wherein the at least one cooling heat exchanger includes a spiral tube, the spiral tube attached to the first flange and the second flange.

6. The heating and cooling unit of claim 2, wherein the at least one cooling heat exchanger includes a tube having a first end and a second end, the first end and second end of the tube attached to the second flange, the at least one electric heating element attached to the first flange.

7. A heating and cooling unit for controlling the temperature of a working fluid, the heating and cooling unit comprising:

an outer housing defining a plenum, the outer housing having a working fluid inlet, a working fluid outlet, a cooling fluid inlet, and a cooling fluid outlet, the cooling fluid inlet and the cooling fluid outlet in fluid communication with the plenum;

at least one heat exchanger pipe situated longitudinally within the outer housing and extending through the plenum, the heat exchanger pipe having an axial bore extending between first and second ends thereof and connected to the cooling fluid inlet at the first end and to the cooling fluid outlet at the second end, the cooling fluid inlet and the cooling fluid outlet in fluid communication and aligned with the axial bore of the heat exchanger pipe, the heat exchanger pipe capable of receiving the working fluid from the working fluid inlet and sending the working fluid to the working fluid outlet; and at least one electric heating element extending within the at least one heat exchanger pipe and capable of heating the working fluid.

8. The heating and cooling unit of claim 7, wherein the outer housing includes a first flange, a second flange, and a tubular shell, the tubular shell attached to the first flange and the second flange.

9. The heating and cooling unit of claim 8, wherein the at least one heat exchanger includes a tube and a plurality of longitudinal fins, the longitudinal fins attached to the tube, the tube attached to the first flange and the second flange.

10. The heating and cooling unit of claim 8, wherein the at least one heat exchanger includes a tube, the tube being at least partially corrugated, the tube attached to the first flange and a second flange.

11. The heating and cooling unit of claim 8, wherein the at least one cooling heat exchanger includes a spiral tube, the spiral tube attached to the first flange and the second flange.

12. The heating and cooling unit of claim 8, wherein the at least one cooling heat exchanger includes a tube having a first end and a second end, the first end and second end of the tube attached to the second flange, the at least one electric heating element attached to the first flange.

13. A system for heating and cooling a working fluid, the system comprising:

a controller;

a working fluid flow control means electrically connected to the controller to control the flow of the working fluid; and a heating and cooling unit having an outer housing, at least one electric heating element, and at least one cooling heat exchanger pipe, wherein the outer housing defines a plenum to carry the working fluid;

wherein the at least one electric heating element is mounted to the outer housing and electrically connected to the controller, and at least one electric heating element extending into the plenum and capable of heating the working fluid, wherein the at least one cooling heat exchanger pipe is situated longitudinally within and mounted to the outer housing, the cooling heat exchanger pipe has an axial bore extending between first and second ends thereof and is connected to the cooling fluid inlet at the first end and to the cooling fluid outlet at the second end, the cooling fluid inlet and the cooling fluid outlet are in fluid communication and aligned with the axial bore of the cooling heat exchanger pipe, the at least one cooling heat exchanger pipe extends through the plenum and is capable of cooling the working fluid.

14. The system of claim 13, wherein the system further comprises of a cooling fluid flow control means electrically connected to the controller to control the flow of a cooling fluid.

15. The system of claim 13, wherein the outer housing has a working fluid inlet, a working fluid outlet, a cooling fluid inlet, and a cooling fluid outlet, the cooling heat exchanger capable of receiving a cooling fluid from the cooling fluid inlet and sending the cooling fluid to the cooling fluid outlet.

16. The system of claim 13, wherein the outer housing includes a first flange, a second flange, and a tubular shell, the tubular shell attached to the first flange and the second flange.

17. The system of claim 16, wherein the at least one cooling heat exchanger includes a tube and a plurality of longitudinal fins, the longitudinal fins attached to the tube, the tube attached to the first flange and the second flange.

18. The system of claim 16, wherein the at least one cooling heat exchanger includes a tube, the tube being at least partially corrugated, the tube attached to the first flange and a second flange.

19. The system of claim 16, wherein the at least one cooling heat exchanger includes a spiral tube, the spiral tube attached to the first flange and the second flange.

20. The system of claim 16, wherein the at least one cooling heat exchanger includes a tube having a first end and a second end, the first end and second end of the tube attached to the second flange, the at least one electric heating element attached to the first flange.

21. A system for heating and cooling a working fluid, the system comprising:

a controller;

a working fluid flow control means electrically connected to the controller to control the flow of the working fluid; and a heating and cooling unit having an outer housing, at least one heat exchanger, and at least one electric heating element, wherein the outer housing defines a plenum to carry a cooling fluid, wherein the at least one heat exchanger pipe is situated longitudinally within and mounted to the outer housing, the heat exchanger pipe has an axial bore extending between first and second ends thereof and is connected to a cooling fluid inlet at the first end and to a cooling fluid outlet at the second end, the cooling fluid inlet and the cooling fluid outlet are in fluid communication and aligned with the axial bore of the heat exchanger pipe, the at least one heat exchanger pipe extends through the plenum and is capable of cooling the working fluid, wherein the at least one electric heating element is mounted to the outer housing and electrically connected to the controller, the at least one electric heating element extending within the heat exchanger and capable of heating the working fluid.

22. The system of claim 21, wherein the system further comprises of a cooling fluid flow control means electrically connected to the controller to control the flow of a cooling fluid.

23. The system of claim 21, wherein the outer housing has a working fluid inlet and a a working fluid outlet, and a cooling fluid outlet, the heat exchanger capable of receiving the working fluid from the working fluid inlet and sending the working fluid to the working fluid outlet.

24. The system of claim 21, wherein the outer housing includes a first flange, a second flange, and a tubular shell, the tubular shell attached to the first flange and the second flange.

25. The system of claim 24, wherein the at least one heat exchanger includes a tube and a plurality of longitudinal fins, the longitudinal fins attached to the tube, the tube attached to the first flange and the second flange.

26. The system of claim 24, wherein the at least one heat exchanger includes a tube, the tube being at least partially corrugated, the tube attached to the first flange and a second flange.

27. The system of claim 24, wherein the at least one heat exchanger includes a spiral tube, the spiral tube attached to the first flange and the second flange.

28. The system of claim 24, wherein the at least one cooling heat exchanger includes a tube having a first end and a second end, the first end and second end of the tube attached to the second flange, the at least one electric heating element attached to the first flange.

* * * * *

UNITED STATES PATENT AND TRADEMARK OFFICE

CERTIFICATE OF CORRECTION

PATENT NO. : 6,668,136 B2
DATED : December 23, 2003
INVENTOR(S) : Sam W. Henry et al.

It is certified that error appears in the above-identified patent and that said Letters Patent is hereby corrected as shown below:

Column 4,
Line 16, delete “modification” and substitute therefor -- modifications --.
Line 34, delete “system 112” and substitute therefor -- system 100 --.

Column 5,
Line 24, delete “chiller of” and substitute therefor -- chiller or --.
Line 27, delete “elements 150” and substitute therefor -- elements 250 --.

Column 8,
Line 33, delete “34” and substitute therefor -- 334 --.

Column 10,
Line 19, delete “312: however;” and substitute therefor -- 312; however, --.
Line 47, delete “Alternative” and substitute therefor -- Alternatively --.
Line 60, delete “elements” and substitute therefor -- element --.

Column 11,
Line 17, delete “chiller of” and substitute therefor -- chiller or --.

Column 13,
Line 38, after “comprises” delete “of”.

Column 14,
Line 34, after “comprises” delete “of”.
Line 38, delete “inlet and a a working” and substitute therefor -- inlet and a working --.
Lines 37-38, delete “and a cooling fluid outlet”.

Signed and Sealed this

Thirteenth Day of July, 2004

JON W. DUDAS
*Acting Director of the United States Patent and Trademark Office*